US012440879B2

(12) United States Patent
Hong et al.

(10) Patent No.: US 12,440,879 B2
(45) Date of Patent: Oct. 14, 2025

(54) WIRE DRAWING METHOD AND WIRE DRAWING DEVICE

(71) Applicant: HITACHI, LTD., Tokyo (JP)

(72) Inventors: Younjeong Hong, Tokyo (JP); Chengting Hsieh, Tokyo (JP)

(73) Assignee: HITACHI, LTD., Tokyo (JP)

( * ) Notice: Subject to any disclaimer, the term of this patent is extended or adjusted under 35 U.S.C. 154(b) by 149 days.

(21) Appl. No.: 18/021,700

(22) PCT Filed: Sep. 28, 2021

(86) PCT No.: PCT/JP2021/035534
§ 371 (c)(1),
(2) Date: Feb. 16, 2023

(87) PCT Pub. No.: WO2022/085375
PCT Pub. Date: Apr. 28, 2022

(65) Prior Publication Data

US 2023/0330731 A1 Oct. 19, 2023

(30) Foreign Application Priority Data

Oct. 22, 2020 (JP) ..... 2020-177502
Jul. 13, 2021 (JP) ..... 2021-116021

(51) Int. Cl.
*B21C 23/08* (2006.01)

(52) U.S. Cl.
CPC ..... *B21C 23/08* (2013.01)

(58) Field of Classification Search
CPC ..... B21C 23/08; B21C 1/02; B21C 37/04; B21C 37/045; B21C 37/154
See application file for complete search history.

(56) References Cited

U.S. PATENT DOCUMENTS 3,532,476 A * 10/1970 Peehs ..... H01J 45/00 138/146
3,625,662 A * 12/1971 Roberts ..... B21C 37/045 428/592

(Continued)

FOREIGN PATENT DOCUMENTS

JP S48-25655 A 4/1973
JP S61-033710 A 2/1986

(Continued)

OTHER PUBLICATIONS

International Search Report, mailed Dec. 14, 2021, for International Application No. PCT/JP2021/035534.

*Primary Examiner* — Teresa M Ekiert
(74) *Attorney, Agent, or Firm* — Baker Botts L.L.P.

(57) ABSTRACT

A wire drawing method includes: preparing a first wire rod that includes a first pipe having a first longitudinal length and a second pipe having a second longitudinal length different from the first longitudinal length; creating a second wire rod that includes the first pipe having a third longitudinal length and the second pipe having a fourth longitudinal length different from the third longitudinal length, by reducing a cross-sectional diameter of the first wire rod through wire drawing; and setting a first difference between the third longitudinal length and the fourth longitudinal length in the second wire rod to be smaller than a second difference between the first longitudinal length and the second longitudinal length in the first wire rod.

8 Claims, 12 Drawing Sheets

(56) References Cited

U.S. PATENT DOCUMENTS

| | | | | |
|---|---|---|---|---|
| 3,863,328 | A * | 2/1975 | Arntz | B21C 37/154 29/523 |
| 7,243,409 | B2 * | 7/2007 | Lewis | B21C 37/154 29/469 |
| 2020/0130035 | A1 | 4/2020 | Rauffmann et al. | |

FOREIGN PATENT DOCUMENTS

| | | | |
|---|---|---|---|
| JP | S63-274022 | A | 11/1988 |
| JP | H03-254019 | A | 11/1991 |
| JP | H05-307917 | A | 11/1993 |
| JP | 2009-176664 | A | 8/2009 |
| JP | 2009-269069 | A | 11/2009 |
| JP | 2012-074244 | A | 4/2012 |
| JP | 2013-252565 | A | 12/2013 |
| JP | 2019-503868 | A | 2/2019 |

* cited by examiner

WIRE DRAWING METHOD AND WIRE DRAWING DEVICE

TECHNICAL FIELD

The present invention relates to a wire drawing method and a wire drawing device.

BACKGROUND ART

A high-temperature superconducting wire rod is manufactured by filling metal pipes with mixed powder, by additionally inserting a plurality of the metal pipes filled with the mixed power, into a pipe, and by processing the pipe into a thin and long wire rod through a wire drawing method. Generally, a wire drawing method used for metal pipes or metal bars is applied to this technique. A drawing method that is one example of the wire drawing method is described in, for example, Patent Document 1.

The drawing method is a processing method for reducing a cross-sectional diameter of a material to be wire-drawn to the same diameter as a hole diameter of a dice hole by passing the material through the dice hole having the hole diameter smaller than a maximum diameter of the material. The step of passing the material through the dice hole that is gradually reduced in dice hole diameter is performed a plurality of times until the desired cross-sectional diameter is obtained.

CITATION LIST

Patent Document

Patent Document 1: JP 2013-252565 A

SUMMARY OF THE INVENTION

Problems to be Solved by the Invention

For example, the high-temperature superconducting wire rod is formed of a plurality of metal pipes having different deformation resistances, such as copper pipes, aluminum pipes, or iron pipes, and is obtained by wire-drawing a material formed of a plurality of metal pipes.

When the drawing method is used, a thin and long wire rod is manufactured by repeatedly performing the step of passing the material through the dice hole. In the wire drawing of a pipe formed of a plurality of pipes, deformation starts from the metal pipe located on an outermost peripheral side. For this reason, the closer the metal pipe is disposed to a central portion in a cross-sectional direction, the more the start of deformation tends to delay.

As a result, since the deformation of the metal pipe located on the outermost peripheral side occurs first, the longitudinal length is lengthened. On the other hand, since the occurrence of deformation of the material located at the cross-sectional central portion is delayed, the longitudinal length is shortened.

For example, when a material is formed of metal materials having different deformation resistances such as a high-temperature superconducting wire rod, the amount of deformation varies for each metal material, so that the longitudinal length also varies for each metal material. In order to obtain a shape characteristic required for the high-temperature superconducting wire rod, it is necessary to uniformize a longitudinal cross-sectional shape of the wire rod.

An object of the present invention is to uniformize a longitudinal cross-sectional shape of a wire rod in a wire drawing method.

Solutions to Problems

According to one aspect of the present invention, there is provided a wire drawing method for reducing a cross-sectional diameter of a wire rod including at least a first pipe and a second pipe provided around the first pipe, through wire drawing, the method including: preparing a first wire rod that includes the first pipe having a first longitudinal length and the second pipe having a second longitudinal length different from the first longitudinal length; creating a second wire rod that includes the first pipe having a third longitudinal length and the second pipe having a fourth longitudinal length different from the third longitudinal length, by reducing the cross-sectional diameter of the first wire rod through the wire drawing; and setting a first difference between the third longitudinal length and the fourth longitudinal length in the second wire rod to be smaller than a second difference between the first longitudinal length and the second longitudinal length in the first wire rod.

According to one aspect of the present invention, there is provided a wire drawing device including: a dice having a hole diameter smaller than a maximum diameter of a wire rod including at least a first pipe and a second pipe provided around the first pipe; and a grip portion that grips one end portion of the wire rod and that pulls the one end portion in a predetermined direction with a predetermined tensile force. A cross-sectional diameter of the wire rod is reduced by passing the wire rod through a hole of the dice and by pulling the grip portion, which grips the end portion of the wire rod, in the predetermined direction with the predetermined tensile force. A first wire rod that includes the first pipe having a first longitudinal length and the second pipe having a second longitudinal length different from the first longitudinal length is prepared, a second wire rod that includes the first pipe having a third longitudinal length and the second pipe having a fourth longitudinal length different from the third longitudinal length is created by reducing the cross-sectional diameter of the first wire rod by passing the first wire rod through the hole of the dice and by pulling the grip portion, which grips the end portion of the first wire rod, in the predetermined direction with the predetermined tensile force, and a first difference between the third longitudinal length and the fourth longitudinal length in the second wire rod is set to be smaller than a second difference between the first longitudinal length and the second longitudinal length in the first wire rod.

Effects of the Invention

According to one aspect of the present invention, in the wire drawing method, it is possible to uniformize a longitudinal cross-sectional shape of the wire rod.

MODE FOR CARRYING OUT THE INVENTION

Hereinafter, the present invention will be described in detail based on an embodiment.

The embodiment relates to wire drawing of a high-temperature superconducting wire rod or a material formed of a plurality of metal pipes. For example, since the longitudinal length differs depending on the metal pipe in a drawing method, it is necessary to cut both end portions having different cross-sectional shapes.

As a result, when a plurality of wire drawings are performed, it is necessary to perform cutting in a plurality of times. In order to obtain the performance of the high-temperature superconducting wire rod, it is necessary to uniformize a longitudinal cross-sectional shape and to reduce the number of steps in wire drawing.

For this reason, in the embodiment, with regard to a material formed of a plurality of metal pipes or metal bars, the metal pipes and the metal bars are set to have shapes with different lengths and different thicknesses by varying deformation resistance and the disposition of the material, instead of being uniform in length before being processed.

For example, the lengths of the metal pipes before being processed, which are determined by the deformation resistance and the disposition, are used based on examination results obtained from computer aided engineering (CAE). In the CAE examination, wire drawing that reduces a maximum cross-sectional diameter of the material before being subjected to wire drawing, by 10% or more is examined by CAE.

When the cross-sectional diameter of each metal pipe is reduced below an initial cross-sectional diameter by 10% or more, a longitudinal length of each metal pipe is measured, a difference between the longitudinal length of each metal pipe and a minimum longitudinal length of the metal pipes is calculated, and the length of each metal pipe before being subjected to wire drawing is shortened by the difference.

According to the embodiment, a cut portion of an end portion of the material is reduced by uniformizing cross-sectional deformation in a length direction in the wire drawing. Accordingly, material loss can be reduced. Further, due to the reduction in the number of cutting steps, the number of steps in the wire drawing can be reduced, and manufacturing cost can be reduced.

Hereinafter, embodiments will be described with reference to the drawings.

First Embodiment

An example of a wire rod that is a material formed of a plurality of metal pipes and one metal bar will be described with reference to FIG. 1.

Figure 1:
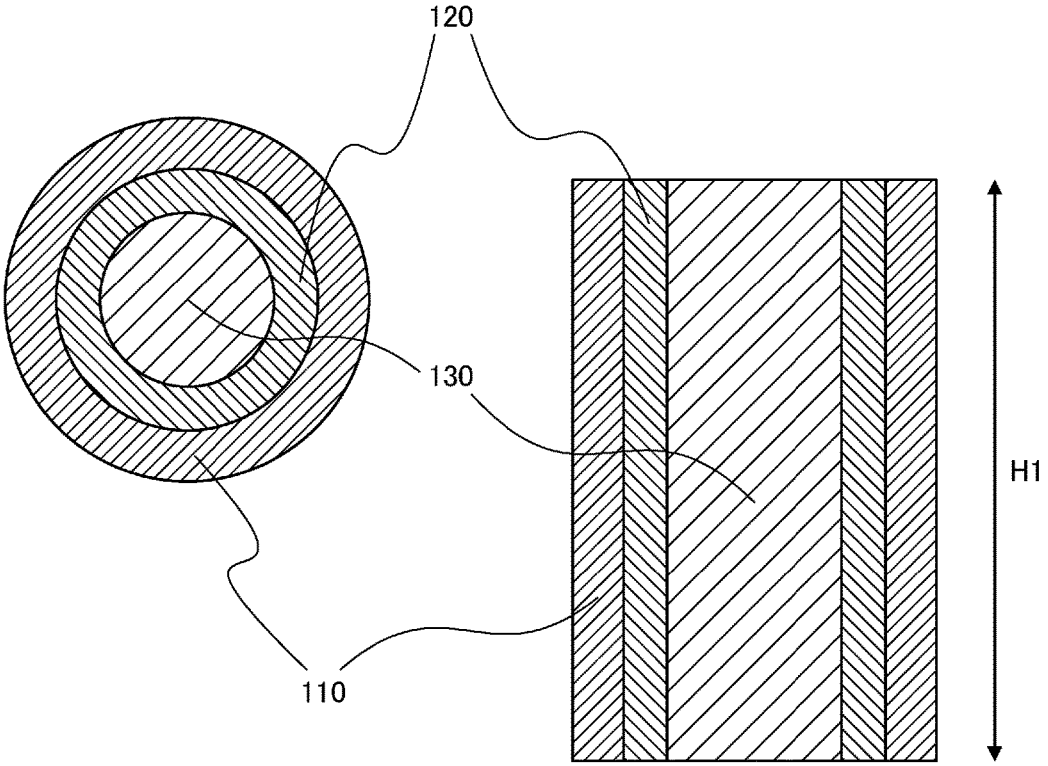
FIG. 1 is a cross-sectional side view of a material formed of a plurality of metal pipes and metal bars.

As illustrated in FIG. 1, the wire rod is formed such that a metal pipe 120 is disposed on a radially inner side of a metal pipe 110 and a metal bar 130 is disposed on a radially inner side of the metal pipe 120. The metal pipe 110, the metal pipe 120, and the metal bar 130 have the same length, different inner and outer diameters, and an arc-shaped cross-sectional shape. The longitudinal length of the wire rod is H1.

Examples of a processing method for wire-drawing a wire rod include drawing, cassette roll processing, groove roll processing, and the like, and among these processing methods, in the first embodiment, drawing will be described as an example. A configuration of a drawing device that is one example of a wire drawing device will be described with reference to FIG. 2.

Figure 2:
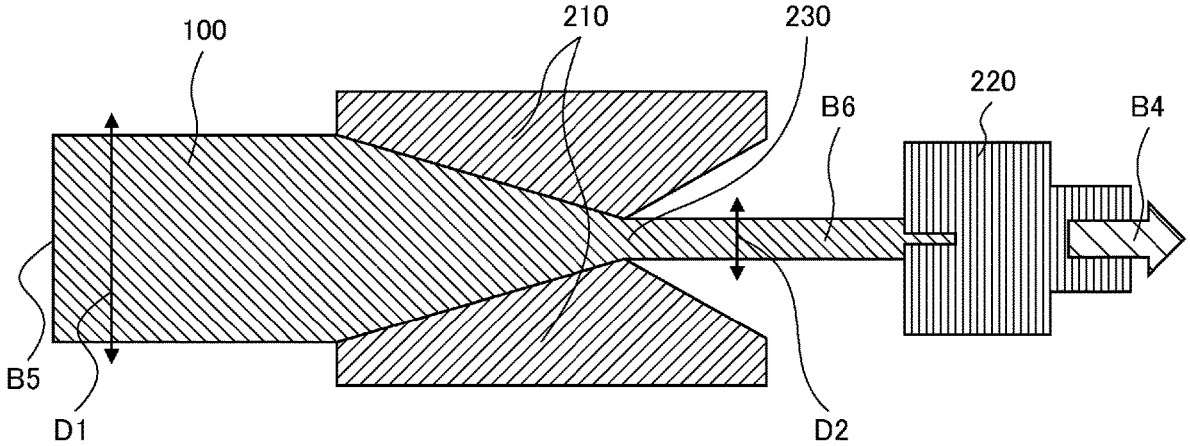
FIG. 2 is a simplified view of a drawing device.

As illustrated in FIG. 2, the drawing device includes a dice 210 with a hole 230 and a grip portion (chuck portion) 220. A wire rod 100 having an initial diameter D1 at an end portion B5 is advanced by pulling the grip portion 220 in a direction B4 with a predetermined tensile force in a state where an end portion B6 of the wire rod 100 is gripped by the grip portion 220. Accordingly, the cross-sectional diameter D1 of the end portion B5 is reduced to a cross-sectional diameter D2 of the end portion B6.

Specifically, the wire rod 100 is passed through the hole 230 of the dice 210 by pulling the wire rod 100 in the direction B4 with the grip portion 220. The initial diameter D1 of the wire rod 100 that has passed through the hole 230 of the dice 210 becomes smaller than a dice diameter B7, and is reduced to the cross-sectional diameter D2. As a result, the wire rod 100 that has passed through the hole 230 is lengthened in longitudinal length while being reduced in cross-sectional diameter.

In drawing in which the cross-sectional diameter is reduced, deformation occurs from a radially outer side of the wire rod 100, and as the cross-sectional reduction rate increases, namely, as the cross-sectional diameter becomes smaller, the deformation moves to a cross-sectional central portion side.

In addition, the deformation speed of the metal pipes 110 and 120 or the metal bar 130 having low deformation resistance is high. For this reason, the metal pipes 110 and 120 or the metal bar 130 having low deformation resistance is lengthened in longitudinal length after being subjected to drawing than before being subjected to drawing.

Second Embodiment

For the wire rod 100 formed of the metal pipes 110 and 120 and the metal bar 130 illustrated in FIG. 1, when a material in which the metal pipes 110 and 120 and the metal bar 130 have the same deformation resistance or a material in which the metal pipes 110 and 120 and the metal bar 130 have different deformation resistances is used, the length varies for each metal pipe that has passed through the hole 230 of the dice 210 of the drawing device illustrated in FIG. 2.

Figure 3A:
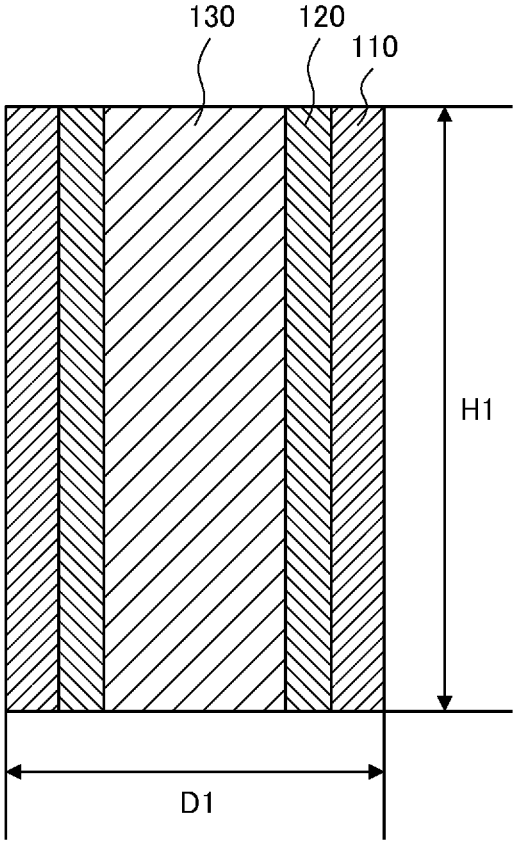
FIG. 3A is a side view of a material formed of a plurality of metal pipes and metal bars before being subjected to drawing.
Figure 3B:
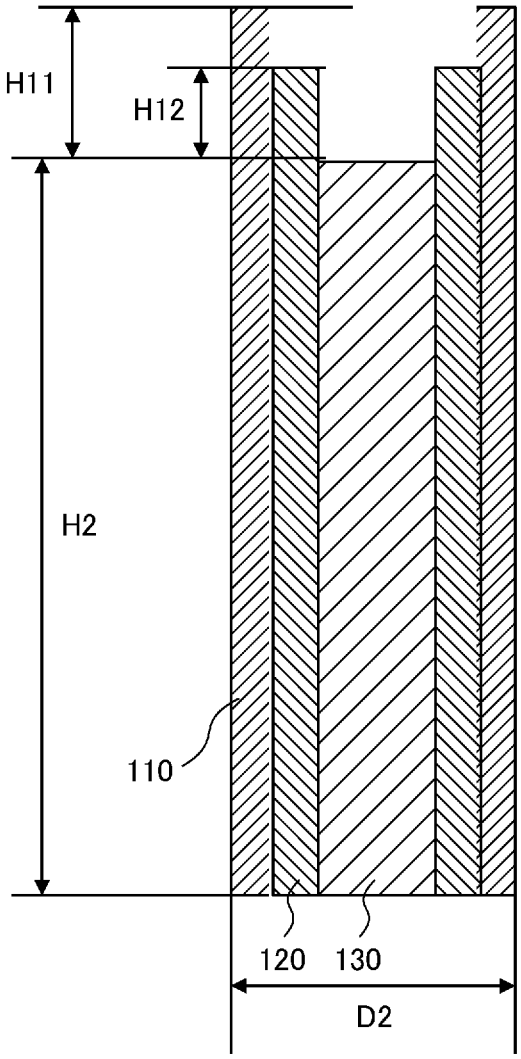
FIG. 3B is a side view of the material formed of the plurality of metal pipes and metal bars after being subjected to drawing.
Figure 3C:
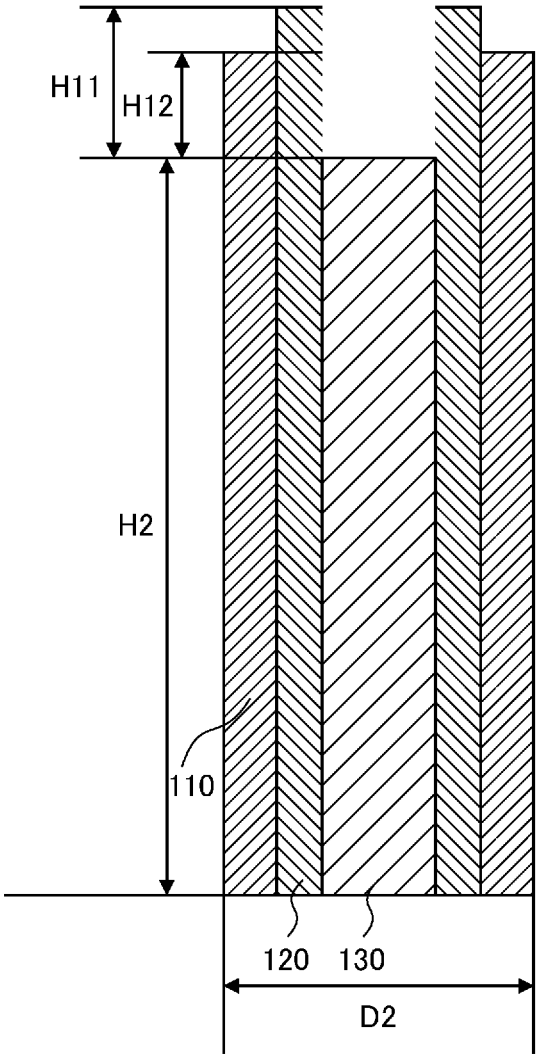
FIG. 3C is a side view of the material formed of the plurality of metal pipes and metal bars after being subjected to drawing.

FIGS. 3A, 3B, and 3C illustrate longitudinal lengths H1 and H2 of the wire rod 100 before and after being subjected to drawing.

As illustrated in FIG. 3A, the metal pipes 110 and 120 and the metal bar 130 have the same length H1 and the initial diameter D1.

After the wire rod 100 illustrated in FIG. 3A is reduced in cross-sectional diameter from D1 to D2 by the drawing device of FIG. 2, the wire rod 100 has a cross-sectional shape illustrated in FIG. 3B or 3C.

As illustrated in FIG. 3B, the longitudinal length of the metal bar 130 is a shortest length H2. The longitudinal length of the metal pipe 110 is a longest length. The longitudinal length of the metal pipe 110 is longer than H2 by H11. The longitudinal length of the metal pipe 120 is longer than H2 by H12.

In addition, as illustrated in FIG. 3C, the longitudinal length of the metal bar 130 is the shortest length H2. The longitudinal length of the metal pipe 120 is a longest length. The longitudinal length of the metal pipe 110 is longer than H2 by H12. The longitudinal length of the metal pipe 120 is longer than H2 by H11.

As illustrated in FIG. 3B, in the wire rod 100 in which the metal pipes 110 and 120 and the metal bar 130 have the same deformation resistance, when the wire rod 100 having the longitudinal length H1 and the diameter D1 before being subjected to drawing is drawn, the longitudinal lengths of the metal pipes 110 and 120 and the metal bar 130 after being subjected to drawing become different from each other.

Specifically, in FIG. 3B, compared to the length H2 of the metal bar 130 after being subjected to drawing, the metal bar 130 being located at a cross-sectional central portion, the length of the metal pipe 110 located on an outermost peripheral side becomes longer than H2 by H11. The length of the metal pipe 120 located on the radially inner side of the metal pipe 110 becomes longer than the length H2 of the metal bar 130 by H12.

On the other hand, as illustrated in FIG. 3C, in the wire rod 100 in which the metal pipes 110 and 120 and the metal bar 130 have different deformation resistances, compared to the length H2 of the metal bar 130 after being subjected to drawing, the metal bar 130 being located at the cross-sectional central portion, the length of the metal pipe 110 located on the outermost peripheral side becomes longer than H2 by H12. The length of the metal pipe 120 located on the radially inner side of the metal pipe 110 becomes longer than the length H2 of the metal bar 130 by H11.

Figure 5A:
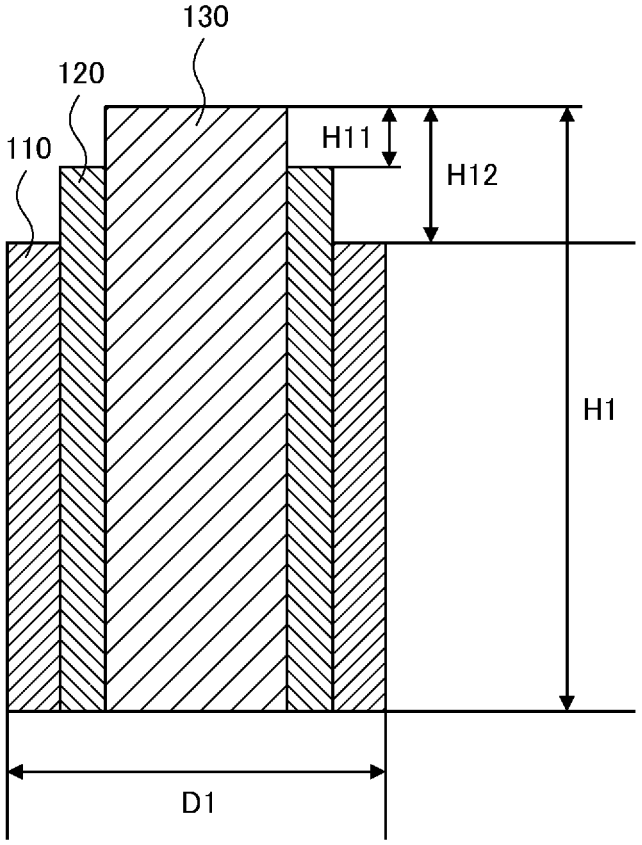
FIG. 5A is a side view of a material formed of a plurality of metal pipes and metal bars having the same deformation resistance, before being subjected to drawing.
Figure 5B:
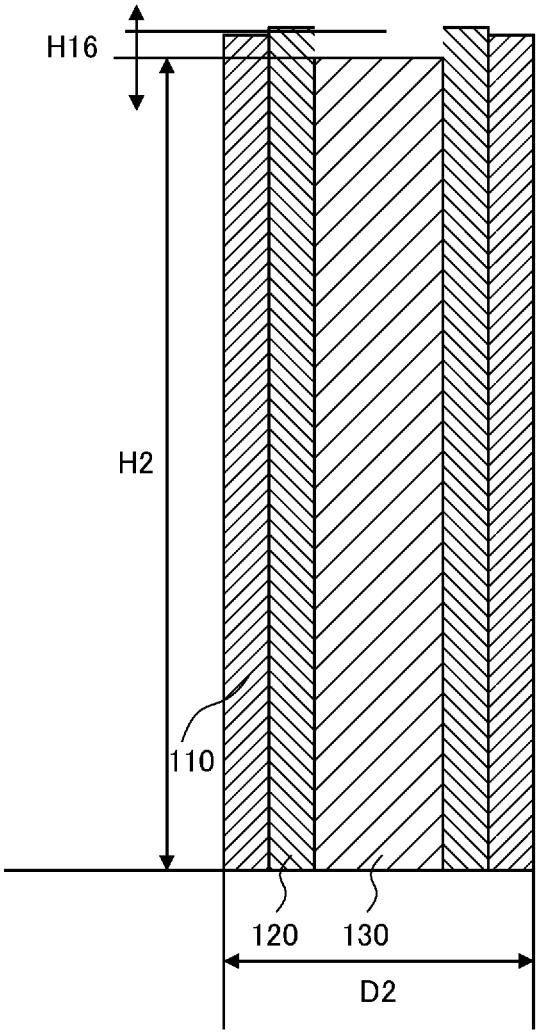
FIG. 5B is a side view of the material formed of the plurality of metal pipes and metal bars having the same deformation resistance, after being subjected to drawing.

With reference to FIGS. 5A and 5B, in order to coincide longitudinal cross-sectional shapes with each other in the wire rod 100 after being subjected to drawing, conditions for uniformizing a length in the wire rod 100 after being subjected to drawing using a material in which deformation resistances are the same will be examined. This examination may be performed, for example, using computer aided engineering (CAE).

As illustrated in FIG. 5A, in the material 100 formed of the metal pipe 110, the metal pipe 120, and the metal bar 130, the length of the metal bar 130 is H1 and a longest length. The length of the metal pipe 120 is H1-H11. The length of the metal pipe 110 is H1-H12.

After the wire rod 100 illustrated in FIG. 5A is reduced in cross-sectional diameter from D1 to D2 by the drawing device of FIG. 2, the wire rod 100 has a cross-sectional shape illustrated in FIG. 5B.

As illustrated in FIG. 5B, the longitudinal length of the metal bar 130 is the shortest length H2. The longitudinal length of the metal pipes 110 and 120 is a longest length and is longer than H2 by H16.

For example, after the initial cross-sectional diameter D1 of the wire rod 100 having the length H1 and formed of the metal pipe 110, the metal pipe 120, and the metal bar 130 having the same deformation resistances and made of low carbon steel was reduced to the cross-sectional diameter D2 by 10 to 15% through drawing, the lengths H11 and H12 after being subjected to drawing (refer to FIG. 3B) were measured. As a result, it was confirmed that with respect to the shortest length H2 of the metal bar 130 after being subjected to drawing, the length of the metal pipe 110 was lengthened by H11 corresponding to 20% and the length of the metal pipe 120 was lengthened by H12 corresponding to 10%.

After the wire rod 100 formed of the metal pipe 120 having the difference H11 with respect to the length H1 of the metal bar 130 and the metal pipe 110 having the difference H12 with respect to the length H1 of the metal bar 130 was reduced in cross-sectional diameter from D1 to D2 by the drawing device of FIG. 2, the difference H16 of the wire rod 100 (refer to FIG. 5B) was examined. As a result, it was confirmed that the length difference H16 after being subjected to drawing illustrated in FIG. 5B was sufficiently smaller than the length differences H11 and H12 after being subjected to drawing illustrated in FIG. 3B.

Third Embodiment

For the wire rod 100 formed of the metal pipes 110 and 120 and the metal bar 130 illustrated in FIG. 1, when a material in which the metal pipes 110 and 120 and the metal bar 130 have different deformation resistances and the deformation resistance of the metal pipe 110 is small is used, the length varies for each metal pipe that has passed through the hole 230 of the dice 210 of the drawing device illustrated in FIG. 2.

Figure 4A:
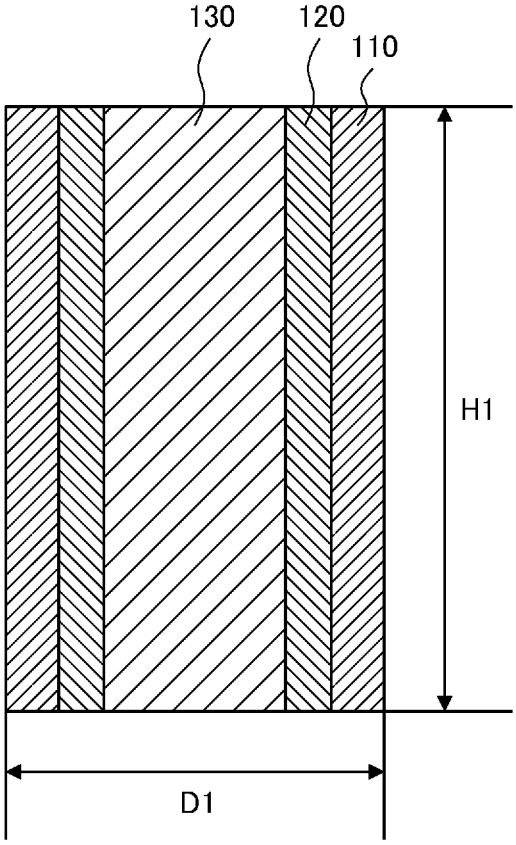
FIG. 4A is a side view of a material formed of a plurality of metal pipes and metal bars before being subjected to drawing.
Figure 4B:
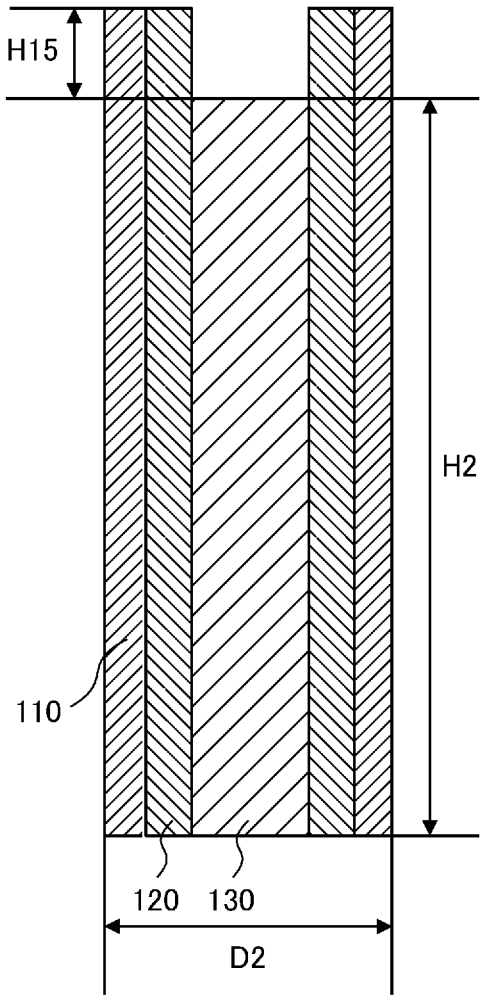
FIG. 4B is a side view of the material formed of the plurality of metal pipes and metal bars after being subjected to drawing.

FIGS. 4A and 4B illustrate the longitudinal lengths H1 and H2 of the wire rod 100 before and after being subjected to drawing.

The metal pipe 110, the metal pipe 120, and the metal bar 130 illustrated in FIG. 4A have different deformation resistances. For example, in the case of the wire rod 100 in which the deformation resistance is the largest in the order of the metal pipe 110, the metal bar 130, and the metal pipe 120, since the deformation resistance of the metal pipe 120 is the smallest, deformation occurs rapidly.

As illustrated in FIG. 4A, the metal pipes 110 and 120 and the metal bar 130 have the same length H1 and the initial diameter D1.

After the wire rod 100 illustrated in FIG. 4A is reduced in cross-sectional diameter from D1 to D2 by the drawing device of FIG. 2, the wire rod 100 has a cross-sectional shape illustrated in FIG. 4B.

As illustrated in FIG. 4B, the longitudinal length of the metal bar 130 is the shortest length H2. The longitudinal length of the metal pipes 110 and 120 is a longest length. The longitudinal length of the metal pipes 110 and 120 is longer than H2 by H15.

As illustrated in the second embodiment, due to the fact that the metal pipe 110 located at the outermost periphery deforms rapidly and the fact that when processing is performed under the same conditions, the smaller the deformation resistance is, the more rapidly deformation occurs, the deformation speeds of the metal pipe 120 having the minimum deformation resistance and of the metal pipe 110 located at the outermost periphery are high. However, since the deformation resistance of the metal pipe 110 located at the outermost periphery is large, the deformation speed is suppressed and the lengths of the metal pipe 110 and the metal pipe 120 after being subjected to drawing are approximately the same.

As described above, in the wire rod 100 in which the metal pipes 110 and 120 and the metal bar 130 have the same deformation resistance, when the wire rod 100 having the longitudinal length H1 and the diameter D1 before being subjected to drawing is drawn, the longitudinal lengths of the metal pipes 110 and 120 and the metal bar 130 after being subjected to drawing become different from each other.

Specifically, compared to the length H2 of the metal bar 130 after being subjected to drawing, the metal bar 130 being located at the cross-sectional central portion, the length of the metal pipe 110 located on the outermost peripheral side and the length of the metal pipe 120 located on the radially inner side of the metal pipe 110 become longer than the length H2 of the metal bar 130 by H15.

Figure 6A:
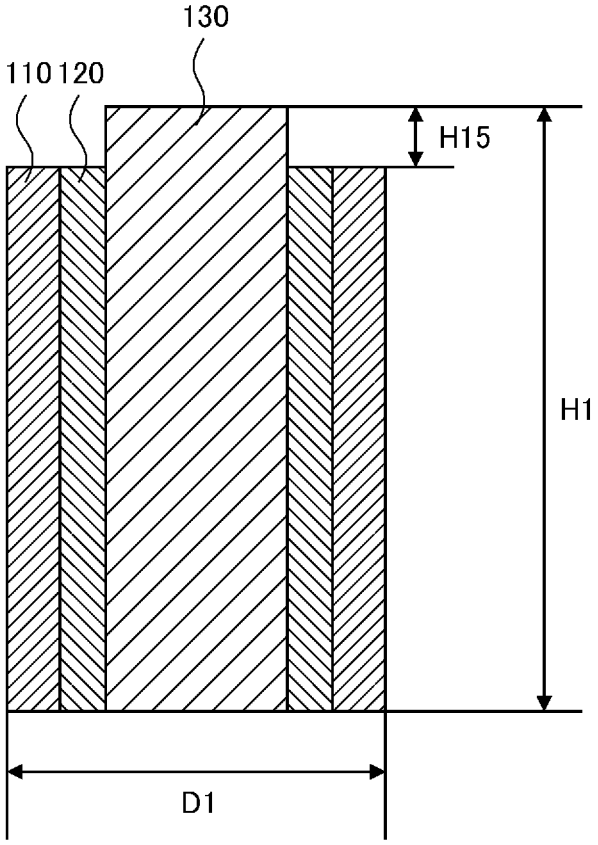
FIG. 6A is a side view of a material which is formed of a plurality of metal pipes and metal bars having different deformation resistances and in which the deformation resistance of the metal pipe located at an outermost periphery is small, before being subjected to drawing.
Figure 6B:
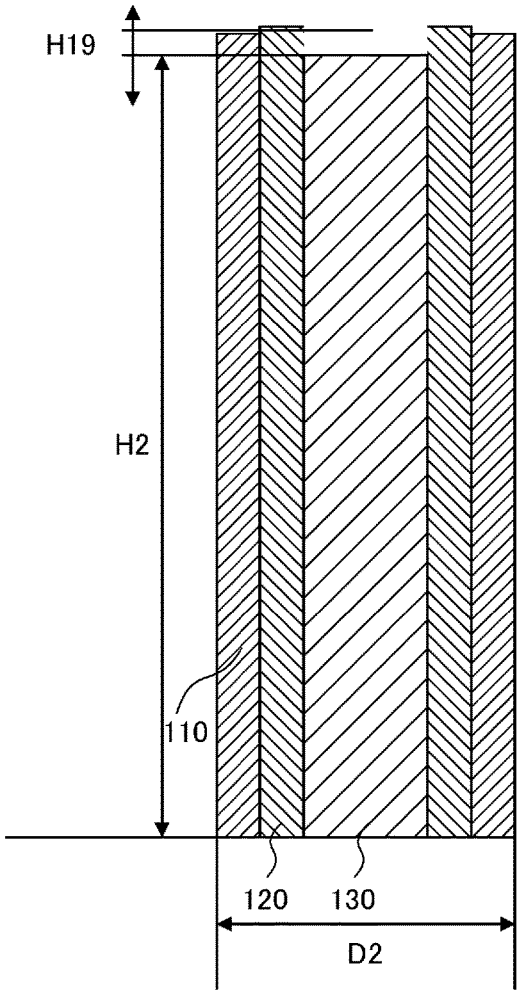
FIG. 6B is a side view of the material which is formed of the plurality of metal pipes and metal bars having the different deformation resistances and in which the deformation resistance of the metal pipe located at the outermost periphery is small, after being subjected to drawing.

With reference to FIGS. 6A and 6B, in order to coincide longitudinal cross-sectional shapes with each other in the wire rod 100 after being subjected to drawing, conditions for uniformizing a length in the wire rod 100 after being subjected to drawing using a material in which deformation resistances are different from each other will be examined. This examination may be performed, for example, using CAE.

As illustrated in FIG. 6A, in the material 100 formed of the metal pipe 110, the metal pipe 120, and the metal bar 130, the length of the metal bar 130 is H1 and a longest length. The length of the metal pipes 110 and 120 is H1-H15.

After the wire rod 100 illustrated in FIG. 6A is reduced in cross-sectional diameter from D1 to D2 by the drawing device of FIG. 2, the wire rod 100 has a cross-sectional shape illustrated in FIG. 6B.

As illustrated in FIG. 6B, the longitudinal length of the metal bar 130 is the shortest length H2. The longitudinal length of the metal pipes 110 and 120 is a longest length and is longer than H2 by H19.

For example, as metal materials having different deformation resistances, a low carbon steel pipe, a pure aluminum pipe, and a pure iron bar were used as the metal pipe 110, the metal pipe 120, and the metal bar 130 of FIG. 6A, respectively, and among three metal materials, the metal pipe 110 had the maximum deformation resistance, and the metal pipe 120 had the minimum deformation resistance.

When the initial cross-sectional diameter D1 of the wire rod 100 having the length H1 and formed of the metal pipe 110, the metal pipe 120, and the metal bar 130 was reduced to the cross-sectional diameter D2 by 10 to 15% through drawing, the length H15 after being subjected to drawing (refer to FIG. 4B) was measured. As a result, it was confirmed that with respect to the shortest length H2 of the metal bar 130 after being subjected to drawing, the length of the metal pipes 110 and 120 was lengthened by H15 corresponding to 16%.

After the wire rod 100 formed of the metal pipes 110 and 120 having the difference H15 with respect to the length H1 of the metal bar 130 and the metal bar 130 was reduced in cross-sectional diameter from D1 to D2 by the drawing device of FIG. 2, the difference H19 of the wire rod 100 (refer to FIG. 6B) was examined. As a result, it was confirmed that the length difference H19 after being subjected to drawing illustrated in FIG. 6B was sufficiently smaller than the length difference H15 after being subjected to drawing illustrated in FIG. 4B.

Fourth Embodiment

Figure 7A:
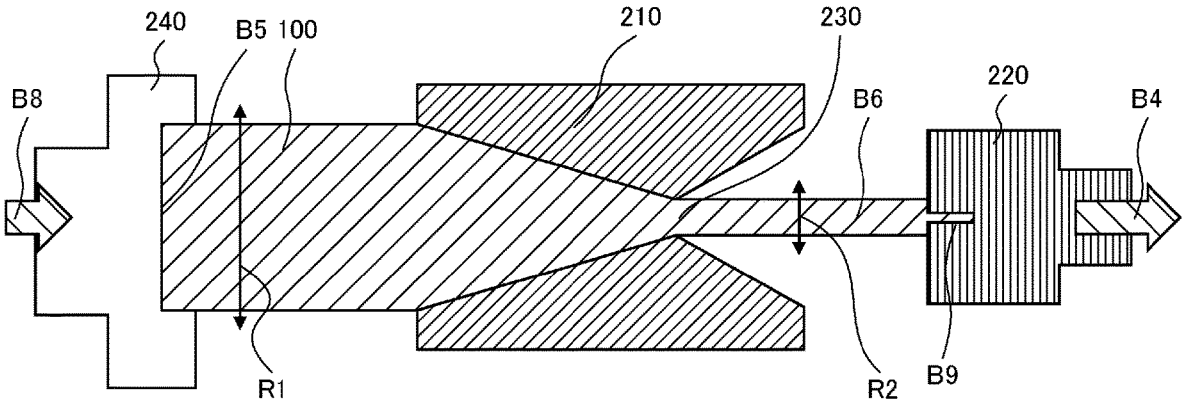
FIG. 7A is a simplified view of a drawing device.
Figure 7B:
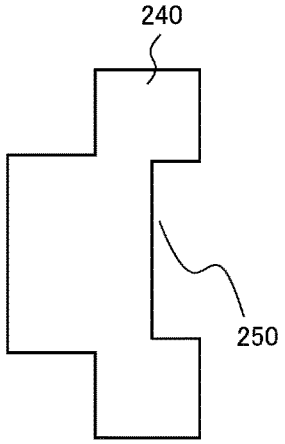
FIG. 7B is a simplified view of a die.

A configuration of a drawing device that uniformizes the lengths in the length direction of the first and second embodiments will be described with reference to FIGS. 7A and 7B. Here, FIG. 7A is a simplified view of the drawing device. FIG. 7B is a simplified view of a die.

The drawing device illustrated in FIG. 7 differs from the drawing device illustrated in FIG. 2 in that a new die 240 (refer to FIG. 7B) is additionally disposed.

In the drawing device, when the wire rod 100 includes both end portions B5 and B9, the grip portion 220 is installed at the end portion B9, and is pulled in the direction B4. In addition, the die 240 that restricts the deformation of the end portion B5 of the wire rod 100 is installed at the end portion B5.

The die 240 is a die that restricts or adjusts the deformation of the end portion B5 of the wire rod 100 in the length direction, and applies a pressing force in the same direction B8 as the tensile direction B4 using a power different from the tensile force of the wire rod 100.

As illustrated in FIG. 7B, the die 240 is provided with a groove portion 250 larger than a maximum diameter of the wire rod 100, and the end portion B5 of the wire rod 100 is installed in the groove portion 250. The pressing force in the direction B8 is set to 100% to 300% of the tensile force in the direction B4. Since other configurations and the like are the same as those of the drawing device illustrated in FIG. 2, descriptions thereof will be omitted.

According to the embodiment, a cut portion of an end portion of the material is reduced by uniformizing cross-sectional deformations in a length direction in wire drawing. Accordingly, material loss can be reduced. Further, due to the reduction in the number of cutting steps, the number of steps in wire drawing can be reduced, and manufacturing cost can be reduced.

Fifth Embodiment

For the wire rod 100 formed of the metal pipes 110 and 120 and the metal bar 130 illustrated in FIG. 1, when a material in which the metal pipes 110 and 120 and the metal bar 130 have different deformation resistances and the deformation resistance of the metal pipe 110 is small is used, the length varies for each metal pipe that has passed through the hole 230 of the dice 210 of the drawing device illustrated in FIG. 2.

FIGS. 3A and 3C illustrate the longitudinal lengths H1 and H2 of the wire rod 100 before and after being subjected to drawing.

The metal pipe 110, the metal pipe 120, and the metal bar 130 illustrated in FIG. 3A have different deformation resistances. For example, in the case of the wire rod 100 in which the deformation resistance is the largest in the order of the metal pipe 110, the metal bar 130, and the metal pipe 120, since the deformation resistance of the metal pipe 110 is the largest, deformation occurs slowly.

As illustrated in FIG. 3A, the metal pipes 110 and 120 and the metal bar 130 have the same length H1 and the initial diameter D1.

After the wire rod 100 illustrated in FIG. 3A is reduced in cross-sectional diameter from D1 to D2 by the drawing device of FIG. 2, the wire rod 100 has a cross-sectional shape illustrated in FIG. 3C.

As illustrated in FIG. 3C, the longitudinal length of the metal bar 130 is the shortest length H2. The longitudinal length of the metal pipe 120 is a longest length. The longitudinal length of the metal pipe 110 is longer than H2 by H12. The longitudinal length of the metal pipe 120 is longer than H2 by H11.

As illustrated in the second embodiment, due to the fact that the metal pipe 110 located at the outermost periphery deforms rapidly and the fact that when processing is performed under the same conditions, the smaller the deformation resistance is, the more rapidly deformation occurs, the deformation speeds of the metal pipe 120 having the minimum deformation resistance and of the metal pipe 110 located at the outermost periphery are high. However, since the deformation resistance of the metal pipe 110 located at the outermost periphery is large, the deformation speed is suppressed and the length of the metal pipe 110 after being subjected to drawing becomes shorter than the length of the metal pipe 120 after being subjected to drawing.

As described above, in the wire rod 100 in which the metal pipes 110 and 120 and the metal bar 130 have different deformation resistances, when the wire rod 100 having the longitudinal length H1 and the diameter D1 before being subjected to drawing is drawn, the longitudinal lengths of the metal pipes 110 and 120 and the metal bar 130 after being subjected to drawing become different from each other.

Specifically, in FIG. 3C, compared to the length H2 of the metal bar 130 after being subjected to drawing, the metal bar 130 being located at the cross-sectional central portion, the length of the metal pipe 110 located on the outermost peripheral side becomes longer than H2 by H12. The length of the metal pipe 120 located on the radially inner side of the metal pipe 110 becomes longer than the length H2 of the metal bar 130 by H11.

Figure 8A:
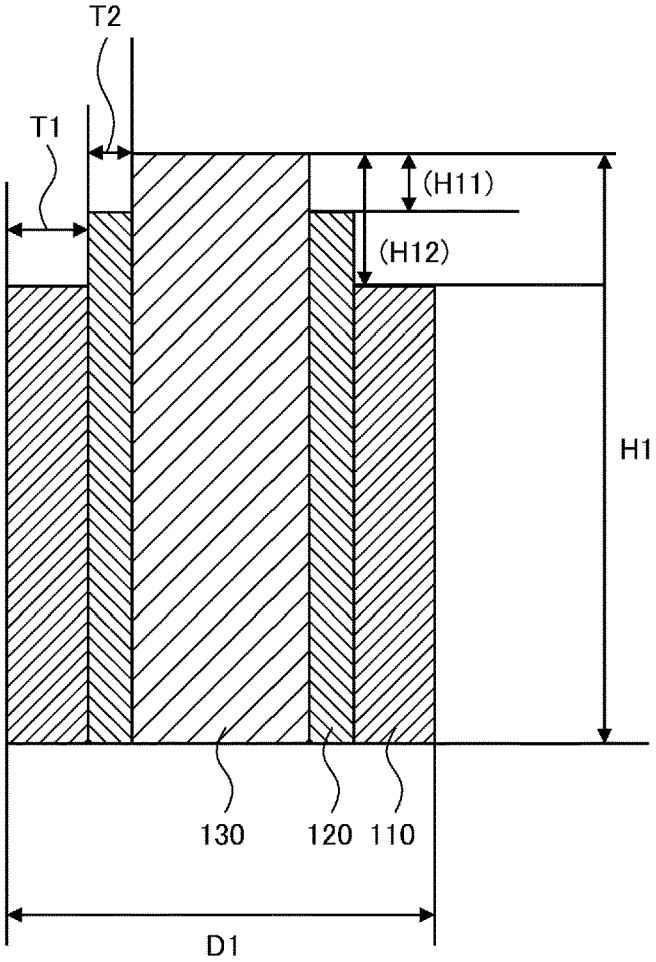
FIG. 8A is a side view of a material which is formed of a plurality of metal pipes and metal bars having different deformation resistances and in which the deformation resistance of the metal pipe located at an outermost periphery is large, before being subjected to drawing.
Figure 8B:
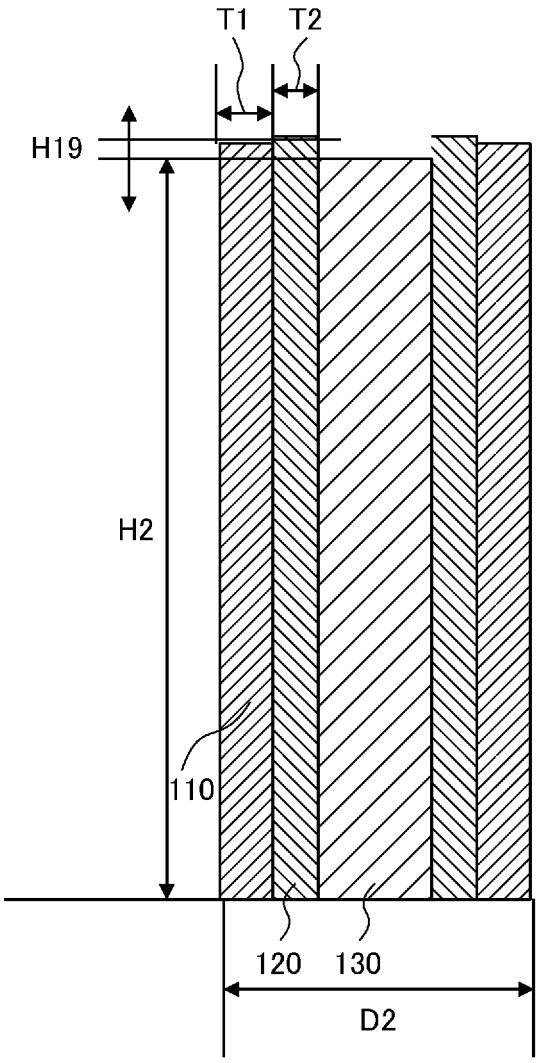
FIG. 8B is a side view of the material which is formed of the plurality of metal pipes and metal bars having the different deformation resistances and in which the deformation resistance of the metal pipe located at the outermost periphery is large, after being subjected to drawing.

With reference to FIGS. 8A and 8B, in order to coincide longitudinal cross-sectional shapes with each other in the wire rod 100 after being subjected to drawing, conditions for uniformizing a length in the wire rod 100 after being subjected to drawing using a material in which deformation resistances are different from each other will be examined. This examination may be performed, for example, using CAE.

As illustrated in FIG. 8A, in the material 100 formed of the metal pipe 110, the metal pipe 120, and the metal bar 130, the length of the metal bar 130 is H1 and a longest length. The length of the metal pipe 110 is H1-H12. The length of the metal pipe 120 is H1-H11.

In addition, with regard to the thicknesses of the metal pipes, the thickness of the metal pipe 110 having large deformation resistance is T1 and the thickness of the metal pipe 120 having small deformation resistance is T2. As described above, the thickness T1 of the metal pipe 110 should be made thicker than the thickness T2 of the metal pipe 120.

After the wire rod 100 illustrated in FIG. 8A is reduced in cross-sectional diameter from D1 to D2 by the drawing device of FIG. 2, the wire rod 100 has a cross-sectional shape illustrated in FIG. 8B.

As illustrated in FIG. 8B, the longitudinal length of the metal bar 130 is the shortest length H2. The longitudinal length of the metal pipes 110 and 120 is a longest length and is longer than H2 by H19.

For example, as metal materials having different deformation resistances, a nickel aluminum alloy pipe, a pure aluminum pipe, and a pure iron bar were used as the metal pipe 110, the metal pipe 120, and the metal bar 130 of FIG. 8A, respectively, and among three metal materials, the metal pipe 110 had the maximum deformation resistance, and the metal pipe 120 and the metal bar 130 had the minimum deformation resistance.

When the initial cross-sectional diameter D1 of the wire rod 100 having the length H1 and formed of the metal pipe 110, the metal pipe 120, and the metal bar 130 was reduced to the cross-sectional diameter D2 by 10 to 15% through drawing, lengths after being subjected to drawing (refer to FIG. 3C) were measured. As a result, it was confirmed that with respect to the shortest length H2 of the metal bar 130 after being subjected to drawing, the length of the metal pipe 110 was lengthened by H12 corresponding to 10% and the length of the metal pipe 120 was lengthened by H11 corresponding to 16%.

After the wire rod 100 formed of the metal pipe 110 having the thickness T1 and the difference H12 with respect to the length H1 of the metal bar 130, the metal pipe 120 having the thickness T2 and the difference H11 with respect thereto, and the metal bar 130 (refer to FIG. 8A) was reduced in cross-sectional diameter from D1 to D2 by the drawing device of FIG. 2, the difference H19 of the wire rod 100 (refer to FIG. 8B) was examined. As a result, it was confirmed that the length difference H19 after being subjected to drawing illustrated in FIG. 8B was sufficiently smaller than the length differences H11 and H12 after being subjected to drawing illustrated in FIG. 3C.

REFERENCE SIGNS LIST

100 Wire rod
110 Metal pipe
120 Metal pipe
130 Metal bar
210 Dice
220 Grip portion
230 Hole
240 Die

The invention claimed is:

1. A wire drawing method comprising:

preparing a first wire rod by surrounding a first rod with a first pipe having a first longitudinal length and a second pipe having a second longitudinal length different from the first longitudinal length;

creating a second wire rod that includes the first pipe having a third longitudinal length and the second pipe having a fourth longitudinal length different from the third longitudinal length, by reducing a cross-sectional diameter of the first wire rod through wire drawing; and setting a first difference between the third longitudinal length and the fourth longitudinal length in the second wire rod to be smaller than a second difference between the first longitudinal length and the second longitudinal length in the first wire rod.

2. The wire drawing method according to claim 1, further comprising:

preparing a third wire rod by surrounding a third rod with a third pipe and a fourth pipe having a same longitudinal length;

creating a fourth wire rod that includes the third pipe having a fifth longitudinal length and the fourth pipe having a sixth longitudinal length different from the fifth longitudinal length, by reducing a cross-sectional diameter of the third wire rod through the wire drawing; and setting a third difference between the fifth longitudinal length and the sixth longitudinal length in the fourth wire rod to the second difference in the first wire rod.

3. The wire drawing method according to claim 1, wherein the first longitudinal length of the first pipe in the first wire rod is longer than the second longitudinal length of the second pipe by the second difference, and the third longitudinal length of the first pipe in the second wire rod is shorter than the fourth longitudinal length of the second pipe by the first difference.

4. The wire drawing method according to claim 2, wherein the third longitudinal length of the third pipe in the fourth wire rod is shorter than the fourth longitudinal length of the fourth pipe by the third difference.

5. The wire drawing method according to claim 1, wherein the first difference is set to be smaller than the second difference such that a longitudinal cross-sectional shape of the second wire rod is uniform at an end portion and a central portion.

6. The wire drawing method according to claim 1, wherein the first wire rod is formed of a superconducting wire rod having a cylindrical cross-section.

7. The wire drawing method according to claim 1, wherein a first deformation resistance of the first pipe is larger than a second deformation resistance of the second pipe, and the first longitudinal length of the first pipe is longer than the second longitudinal length of the second pipe.

8. The wire drawing method according to claim 1, wherein a first deformation resistance of the first pipe is larger than a second deformation resistance of the second pipe, the first longitudinal length of the first pipe is shorter than the second longitudinal length of the second pipe, and a first thickness of the first pipe is thicker than a second thickness of the second pipe.

* * * * *